US005855118A

United States Patent [19]

Lorimer

[11] Patent Number: 5,855,118

[45] Date of Patent: Jan. 5, 1999

[54] COMBINATION CRYOPUMP/GETTER PUMP AND METHOD FOR REGENERATING SAME

[75] Inventor: D'Arcy H. Lorimer, Pismo Beach, Calif.

[73] Assignee: SAES Pure Gas, Inc., San Luis Obispo, Calif.

[21] Appl. No.: 823,748

[22] Filed: Mar. 25, 1997

Related U.S. Application Data

[60] Provisional application No. 60/014,240, Mar. 26, 1996.

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,668,881 | 6/1972 | Thibault et al. | 62/55.5 |
| 4,148,196 | 4/1979 | French et al. | 62/55.5 |
| 4,438,632 | 3/1984 | Lessard | 62/55.5 |
| 4,593,530 | 6/1986 | Longsworth | 62/55.5 |
| 4,910,965 | 3/1990 | Lepofsky et al. | 62/55.5 |
| 5,231,839 | 8/1993 | de Rijke et al. | 62/55.5 |
| 5,357,760 | 10/1994 | Higham | 62/55.5 |

FOREIGN PATENT DOCUMENTS 58-117372 7/1983 Japan .

OTHER PUBLICATIONS

J. Briesacher et al., "Non–Evaporable Getter Pumps for Semiconductor Processing Equipment," Ultra Clean Technology, vol. 1, No. 1, pp. 49–57, 1990.

*Primary Examiner*—Ronald C. Capossela
*Attorney, Agent, or Firm*—Hickman & Martine, LLP

[57] ABSTRACT

A combination cryopump/getter pump including a cryopump section having a cryopump inlet, a getter pump section having a getter pump inlet, and a mechanism for coupling the cryopump section and the getter pump section to a single port of a process chamber to be evacuated. Preferably, a cylindrical cryopump section surrounds a cylindrical getter pump section. Preferably, the cryopump section and the getter pump section are coupled to the common port of the process chamber by a gate valve mechanism. In one embodiment of the present invention, the gate valve mechanism isolates the cryopump inlet and the getter pump inlet when in a closed position, and in another embodiment of the present invention the gate valve does not isolate the cryopump inlet from the getter pump inlet when in a closed position. Preferably, thermal insulation is provided between the getter pump section and the cryopump section to thermally isolate the two sections. The cryopump section preferably includes both a 15° K array and a 80° K array.

30 Claims, 5 Drawing Sheets

COMBINATION CRYOPUMP/GETTER PUMP AND METHOD FOR REGENERATING SAME

CROSS REFERENCE TO RELATED APPLICATIONS

This application claims the benefit of copending U.S. provisional Pat. application No. 60/014,240, entitled Combination Cryopump/Getter Pump And Method For Regenerating Same, filed Mar. 26, 1996 on behalf of D'Arcy H. Lorimer, the disclosure of which is incorporated by reference.

BACKGROUND OF THE INVENTION

1. Field of the Invention

This invention relates generally to vacuum systems and, more particularly, to cryopump vacuum systems used in conjunction with semiconductor manufacturing equipment.

2. Description of the Related Art

Cryopumps are in common use with semiconductor manufacturing equipment. For example, in a physical vapor deposition (PVD) system, a cryopump is used to pump-down a processing chamber to a pressure typically of about $10^{-8}$ torr. The cryopump must be able to accomplish this task without introducing substantial amounts of contaminants into the processing chamber.

In FIG. 1, a prior art cryopump 10 is coupled to a port 12 of a processing chamber 14 by a gate valve assembly 16. The processing chamber 14 may be, for example, a PVD processing chamber. Cryopumps are also used to pump-down chambers of other types of semiconductor manufacturing equipment. A cryopump 10 typically includes a substantially cylindrical casing 18 having an inlet 20 surrounded by a flange 22.

The cryopump 10 is provided with an inlet conduit 24 and an exhaust conduit 26. The inlet conduit 24 opens on the chamber 28 of the cryopump 10 and is typically provided with a shut-off valve 30. The exhaust conduit 26 also opens on the chamber 28, and is coupled to a mechanical pump 32 by a shut-off valve 34. The inlet conduit 24 allows the introduction of a purging gas (such as argon) into the chamber 28. The exhaust conduit 26 and pump 32 allow the removal of gases within the chamber 28.

Disposed within the chamber 28 of cryopump 10 are a number of chevrons 36*a*, 36*b*, 36*c*, and 36*d*. The chevrons are used to disperse gases flowing into inlet 20 within the chamber 28 and comprise a 80° K condensing array or "80° K array." The functioning of the 80° K array will be discussed subsequently. Also disposed within the chamber 28 of cryopump 10 are a number of inverted cups generically referenced at 37. These inverted cups comprise a "15° K array", which will also be discussed subsequently. The 15° K array and the 80° K array are surrounded by a cylindrical 80° K radiation shield 39, and the 15° K array is supported by a cold-head cylinder 41. The cold-head cylinder 41 is supplied with pressurized helium gas at an inlet 43*a*, and exhausts the helium gas at an outlet 43*b*. The cold-head cylinder 41, when supplied with the pressurized helium gas, cools the 15° K array to about 15° K, and cools the 80° K which is supported above the cold-head cylinder 41 and the 15° K array 37 to about 80° K. That is, the 15° K array is cooled to the neighborhood of the temperature of liquid helium, and the 80° K array is cooled to the neighborhood of the temperature of liquid nitrogen.

As noted, cryopump assembly 10 typically includes both a 15° K array and a 80° K array. The 15° K array typically takes the form of inverted cups provided with activated charcoal on their under-sides, and is super-cooled to about 15° Kelvin by the cold head cylinder 41 such that the activated carbon "pumps" light gases, namely, helium, hydrogen and neon, through a chemical adsorption process. The 80° K array typically takes the form of concentric metal chevrons, e.g. chevrons 36*a*–36*d*, and is operative to pump the heavier gases, such as nitrogen, oxygen, carbon monoxide, carbon dioxide, etc. by a chemical absorption process.

A new, or regenerated, cryopump is quite efficient, and can provide an ultrahigh purity vacuum of about $10^{-8}$ torr. The ultimate vacuum level attainable by the cryopump 10 is generally limited by its ability to pump hydrogen ($H_2$). The 15° K array of the cryopump 10 pumps hydrogen relatively slowly, which may allow hydrogen to integrate itself into a film being formed on a semiconductor wafer within processing chamber 14. This is due, in great extent, to the convoluted path that the hydrogen must make to the activated charcoal on the underside of the inverted cups 37 of the 15° K array, resulting in very low "conductance" between these charcoal surfaces and the process chamber 14. This inability to effectively pump hydrogen is particularly problematical in PVD machines where the $H_2$ can get "sputtered" into the film, thereby degrading the film quality.

Hydrogen is continually created within the processing chamber 14 due to, among other things, out-gassing from the stainless steel walls of the chamber 14 and through the decomposition of water on freshly deposited metal films such as aluminum. Since the 15° K array is relatively inefficient in removing this hydrogen, it becomes quickly saturated, requiring "regeneration." Similarly, when the 80° K array becomes saturated with heavier gases it, too, needs to be regenerated. This is typically accomplished by deactivating the cold head cylinder 41 and allowing the cryopump 10 to reach room temperature (approx. 25° C.). At room temperature, the gases trapped within the 15° K array and the 80° K array are released within the chamber 28 and removed from the chamber by the pump 32. A purging gas, such as ultrahigh-purity (UHP) argon, may be released within the chamber 28 during this regeneration process to increase the pressure within the chamber 28, thereby increasing the heat transfer within the pump 32 and providing for a faster regeneration process.

A cryopump 10 is typically coupled to a flange 38 of processing chamber 14 by a gate valve assembly 16. The construction and use of gate valve assemblies is well known to those skilled in the art and, therefore, will not be discussed herein in detail. However, a typical gate valve assembly 16 includes a body 40 having an orifice 42 which can be aligned with the port 12 of the processing chamber 14 and with the inlet 20 of cryopump 10. The body 40 is typically provided with appropriate flanges and seals to provide a gas-tight connection between the cryopump 10 and the processing chamber 14. The gate valve assembly 16 includes a gate 44 and a gate-moving mechanism 46 which can move the gate 44 from the illustrated "open" position to a closed position as illustrated at 44'. When the gate 44 is in the closed position 44', a gas-tight seal is provided by a seal 48 to prevent gases and other materials from moving between the processing chamber 12 and the chamber 28 of the cryopump 10.

Because of the rapid saturation of the cryopump 10 with hydrogen and other gases, such as argon, from a PVD sputtering process, cryopumps have to be regenerated fairly frequently. For example, a cryopump coupled to a PVD machine will have to be regenerated from time to time. This is rather a costly procedure because the semiconductor manufacturing equipment must be taken "off line," thereby slowing or stopping the semiconductor manufacturing process.

It has been suggested that another type of pump known as the non-evaporable getter (NEG) pump be used in combination with cryopumps in an attempt to solve this problem. See, for example, "Non-evaporable Getter Pumps for Semiconductor Processing Equipment," by J. Briesacher et al, *Journal of Ultraclean Technology*, vol. 2, no. 1, 1990. However, as will be discussed subsequently, such combination pumps have been found in the prior to be impractical.

As well known to those skilled in the art, getter pumps utilize "gettering" materials comprising certain metal alloys which have a chemical affinity for particular gases. For example, a metal alloy including 70 percent Zr, 24.6 percent V, and 5.4 percent Fe, has a strong affinity for most gases other than noble gases. These "gettering" materials can therefore be used to quickly "pump" hydrogen through chemical adsorption.

While it is theoretically desirable to combine a cryopump with a getter pump, prior art solutions have been found to be less than desirable. For example, a getter pump could be provided in conjunction with a cryopump, such as by providing a getter pump next to cryopump 10 and mechanical pump 32 of FIG. 1. However, this leads to "form factor" problems because there is often not enough space around a piece of semiconductor manufacturing equipment to accommodate both a cryopump and a getter pump, along with their associated support hardware.

Another solution that has been suggested is to place the active elements of a getter pump within the chamber of a cryopump. However, such a solution tends to be impractical because of the incompatible operating and regenerating cycles of getter pumps and cryopumps. For example, the active elements of a getter pump operate best at about room temperatures, while the active elements of the cryopump operate at cryogenic temperatures, such as 15° K and 80° K. Furthermore, since the cryopump elements require frequent regeneration, the getter pump elements would have to be regenerated at the same frequency. This is a problem because getter pump elements can typically only be regenerated ten or so times, while cryopump elements can be regenerated hundreds of times. This would result in the rapid destruction of the expensive gettering material. Alternatively, if the gettering material were removed from the cryopump assembly prior to the regeneration of the active elements of the cryopump, the cryopump assembly would have to removed and replaced from the apparatus to which it is attached in a time-consuming and potentially system-contaminating procedure.

In U.S. Pat. No. 5,357,760 of Higham a combination cryopump/getter pump is disclosed including a pumping structure having an integral two-stage pump. The first-stage pump is a cryogenic pump having a pump chamber and cryo-arrays mounded on an expander for cryo-condensation of the principal gases present in the vacuum chamber. The second stage pump operates at room temperatures and includes one or more getter pumps whose principal function is to remove hydrogen molecules. A unitary housing is provided to enclose "in a single body" the first pumping stage and the second pumping stage. Therefore, the active elements of a getter pump are within the chamber of a cryopump, as described previously.

The Higham pump therefore has the aforementioned problem of having its cryogenic pump elements and the getter pump elements exposed to the same thermal and atmospheric environment. Since the cryogenic pump elements operate at cryogenic temperatures, and since the getter pump elements operate at near room temperature, the getter pump elements must be thermally shielded from the cryogenic pump elements, decreasing conductance. This conductance is also reduced due to the placement of the getter materials at the bottom of the pump. It should further be noted that the Higham pump eliminates the 15° K array and, therefore, cannot pump neon or helium. The apparent reason to eliminate the 15° K array is to eliminate the potential contamination of an integrated circuit manufacturing process by the charcoal in the array. Also, since the cryogenic pump elements are typically regenerated more frequently, it is necessary to regenerate the getter elements more frequently than would be otherwise required due to the sharing of the same pumping chamber, as described previously. In particular, the high temperatures used for getter regeneration (e.g.>450° C.) will irreversibly damage cryopump elements, especially the Indium gaskets that they typically use. In addition, the high temperatures could damage the refrigeration system of the cryopump.

The prior art, therefore, does not disclose a combination cryopump/getter pump which meets the required form factor for use with semiconductor manufacturing equipment, which is easily used and maintained, and which addresses the special operating and regeneration problems of both cryogenic pump elements and getter pump elements.

SUMMARY OF THE INVENTION

The present invention is a combination cryopump/getter pump having approximately the same dimension as prior art cryopumps alone. The combination pump of the present invention does not suffer from the problems associated with placing the active elements of the getter pump within the chamber of the cryopump. As such, the combination pump of the present invention provides for the more effective removal of hydrogen from a processing chamber while still providing a reasonable working life for the active elements of the getter pump.

Briefly, a combination cryopump/getter pump of the present invention includes a cryopump section having a cryopump inlet, a getter pump section having a getter pump inlet, and a mechanism for coupling the cryopump section and the getter pump section to a single port of a process chamber to be evacuated. A preferred configuration for the combination pump is a substantially cylindrical cryopump section surrounded by a substantially cylindrical getter pump section. The mechanism for coupling the cryopump section and the getter pump section to a common port of a chamber is preferably a gate valve mechanism. In one embodiment of the present invention, the gate valve mechanism isolates the cryopump inlet and the getter pump inlet when in a closed position, and in another embodiment of the present invention the gate valve does not isolate the cryopump inlet from the getter pump inlet when in a closed position. Preferably, thermal insulation is provided between the getter pump section and the cryopump section to thermally isolate the two sections. The cryopump section preferably includes both a 15° K array and a 80° K array.

A method for regenerating a combination cryopump/getter pump apparatus in accordance with the present invention, includes the steps of: a) isolating active elements of a cryopump from active elements of an integrally connected getter pump; and b) regenerating the active elements of at least one of the cryopump and the getter pump. The isolation step can include the step of thermally isolating the active elements of the cryopump from the active elements of the getter pump, such as with a thermal insulation layer. The step of isolating can also include the steps of physically isolating the active elements of the cryopump from the active elements of the getter pump to prevent gaseous communication between those elements. Alternatively, the step of isolating can include the step of creating an inert gas flow from the getter pump to the cryopump to substantially prevent gas flow from the cryopump to the getter pump during the regeneration of active elements of the cryopump. Alternatively, the step of isolating can include the step of creating an inert gas from the cryopump to the getter pump to substantially prevent gas flow from the getter pump to the cryopump during the regeneration of the active elements of the getter pump. The step of regenerating can comprise the step of heating the active elements of the getter pump to regenerate the getter material of the getter pump, and regenerating the active elements of the cryopump by allowing the temperature of the cryopump to rise to about room temperature.

An advantage of the present invention is that a combination cryopump/getter pump is provided which significantly enhances the hydrogen pumping capability of the combined apparatus. Since both the getter pump section and the cryopump section communicate with a single, common port of the processing chamber, a combination pump can be provided which is of the same size, i.e., the same "form factor," as the prior art cryopumps that it replaces. Nonetheless, the cryogenic elements and the getter elements are isolated from each other. The combination pump of the present invention is, therefore, a very good retrofit for existing semiconductor manufacturing equipment.

A further advantage of the present invention is that the getter pump section and the cryopump section can be regenerated independently, thereby accommodating the higher regeneration frequency of the cryopump section without reducing the life of the getter pump section. This isolation takes the form of thermal isolation between the cryopump section and the getter pump section such that the temperature of one section does not greatly affect the temperature of another section, and by preventing gases released during cryopump regeneration from contacting the active elements of the getter pump section and vice versa.

These and other advantages of the present invention will become apparent to those skilled in the art upon a reading of the following specification of the invention and a study of the several figures of the drawing.

DETAILED DESCRIPTION OF THE PREFERRED EMBODIMENTS

Figure 1:
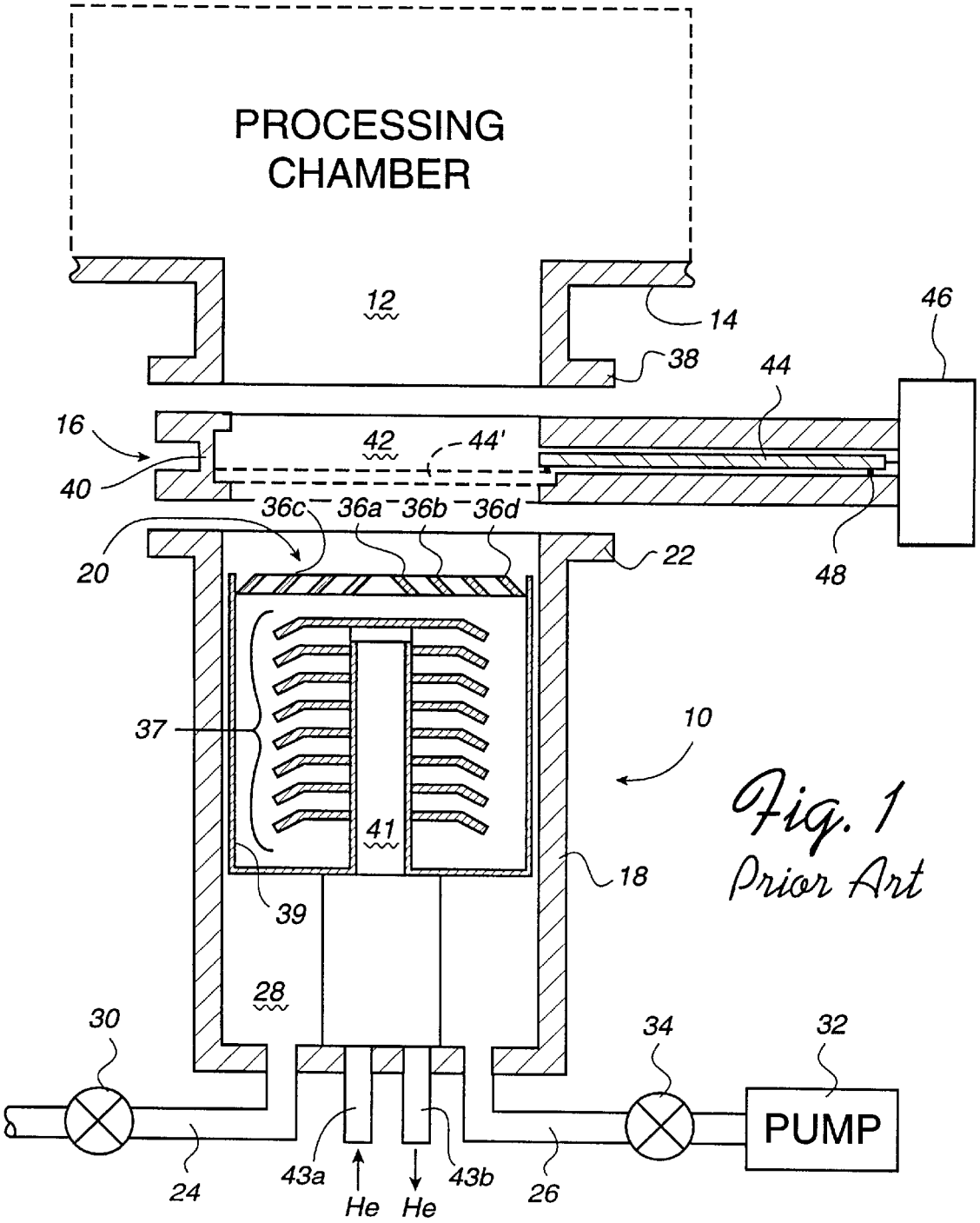
Fig. 1 Prior Art
FIG. 1 is a cross-sectional view of a prior art cryopump assembly coupled to a processing chamber by a gate valve assembly.

In FIG. 1, a prior art cryopump and gate valve assembly was described in the background section of this disclosure. A combination cryopump/getter pump in accordance with the present invention will be described with reference to FIG. 2 and subsequent figures.

Figure 2:
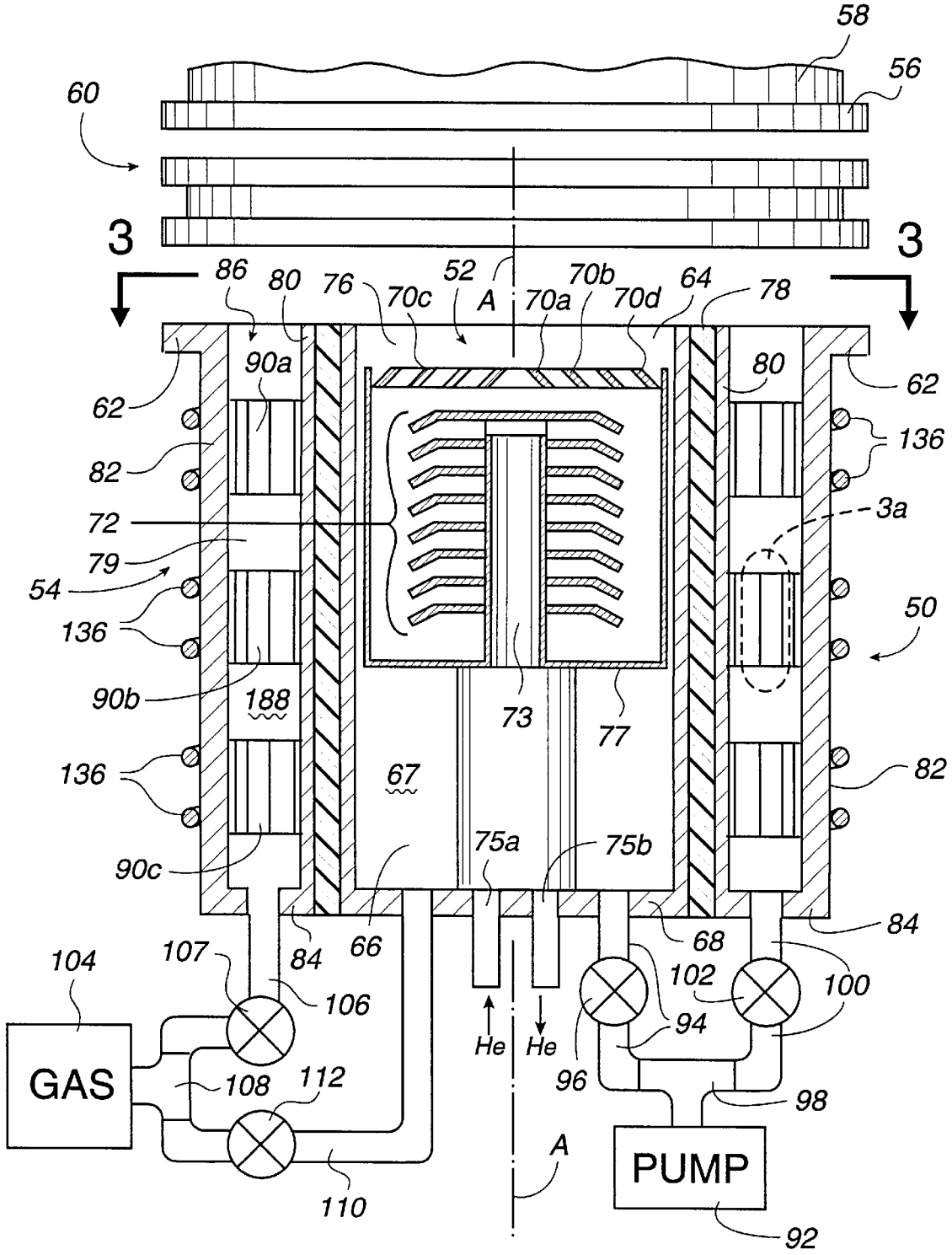
FIG. 2 is a cross-sectional view of a combination cryopump/getter pump assembly in accordance with the present invention.

In FIG. 2, a combination cryopump/getter pump 50 in accordance with the present invention includes a cryopump section 52 and a getter pump section 54. The combination pump 50 is preferably coupled to a flange 56 leading to a single, common port 58 of a processing chamber by a gate valve assembly 60, but it can also be coupled to the port 58 directly by coupling a flange 62 of the getter pump section 54 directly to the flange 56 of the port 58. Of course, appropriate gaskets (not shown) are often utilized between the combination pump 50, the gate valve 69 and the flange 56 to ensure gas-tight seals between those sections. The combination pump 50, gate valve assembly 60, and port 58 of the processing chamber are separated in this figure for clarity, but operationally would be coupled together by appropriate fasteners (not shown) engaging the flanges of the three assemblies.

Cryopump section 52 preferably includes a substantially cylindrical shell 64 made from a suitable material such as stainless steel or aluminum. The shell 64 has substantially cylindrical sidewalls 66 and a substantially circular bottom wall 68. The sidewalls 66 and bottom wall 68 define a cryopump chamber 67. A number of chevrons, such as chevrons 70*a*, 70*b*, 70*c*, and 70*d* are provided within chamber 67 comprising a 80° K array in substantially the same manner as in the prior art. A number of inverted cups shown generically at 72 comprise a 15° K array, as was previously described with reference to the prior art. A coldhead cylinder 73 supports and cools the 15° K array and the 80° K array, as described previously. The cold-head cylinder 73 has a helium gas inlet 75*a* and a helium gas outlet 75*b*. A cylindrical 80° K radiation shield 77 surrounds the 15° K array and the 80° K array, as described previously. The cryopump section 52 has a cryopump inlet 76 which operationally communicates with the port 58 of the processing chamber.

The cryopump section 52 is preferably thermally insulated from the getter pump section 54 by a thermally insulating material 78. Preferably, this thermally insulating material is also cylindrical and is coaxial with an axis A of the cryopump section 52.

The getter pump section 54 is also preferably cylindrical, and includes an inner wall section 80, an outer wall section 82, the aforementioned flange 62 forming the upper lip of outer wall section 82, and an annular bottom wall 84. Again, the construction material of choice is stainless steel or aluminum. The top of the "shell" 79 formed between inner wall section 80 and outer wall section 82 is open and forms a getter pump inlet 86 which operationally communicates with the same port 58 of the processing chamber that the inlet 76 as cryopump section 52. This is preferably accomplished by having the diameter of the combination pump 50 being approximately the same as the diameter of the prior art cryopump that it replaces. In other words, the "form factor" of the combination pump 50 is preferably approximately the same as the prior art cryopump that it replaces. Of course, space permitting, some variance on this "form factor" is also acceptable.

The walls 80, 82, and 84 of the getter pump section 54 define a chamber 88 within the shell 79 in the form of a cylindrical annulus. Within this chamber 88 a number of active elements 90*a*, 90*b*, and 90*c* are provided. As will be explained in greater detail subsequently, these active elements 90*a*–90*c* preferably include corrugated support strips having gettering materials adhered to their surfaces. Suitable gettering materials are available from SAES Getters, Inc., of Lainate, Italy, and will be discussed in greater detail subsequently.

A mechanical pump 92 is coupled to chamber 67 of cryopump section 52 and to chamber 88 of getter pump section 54. More specifically, a conduit 94 provided with a valve 96 is coupled between the chamber 67 and a "T" fitting 98 of pump 92, and a conduit 100 is coupled between chamber 88 and "T" fitting 98 by a valve 102. A source of ultra-high purity (UHP) gas 104, such as argon gas, provided by a number of commercial sources, is coupled to both chambers 67 and 88. More specifically, a conduit 106 is coupled between chamber 88 of getter pump section 54 and a "T" fitting 108 of the gas source 104 by a valve 107, and a conduit 110 including a valve 112 couples the chamber 67 to the "T" fitting 108.

Figure 3:
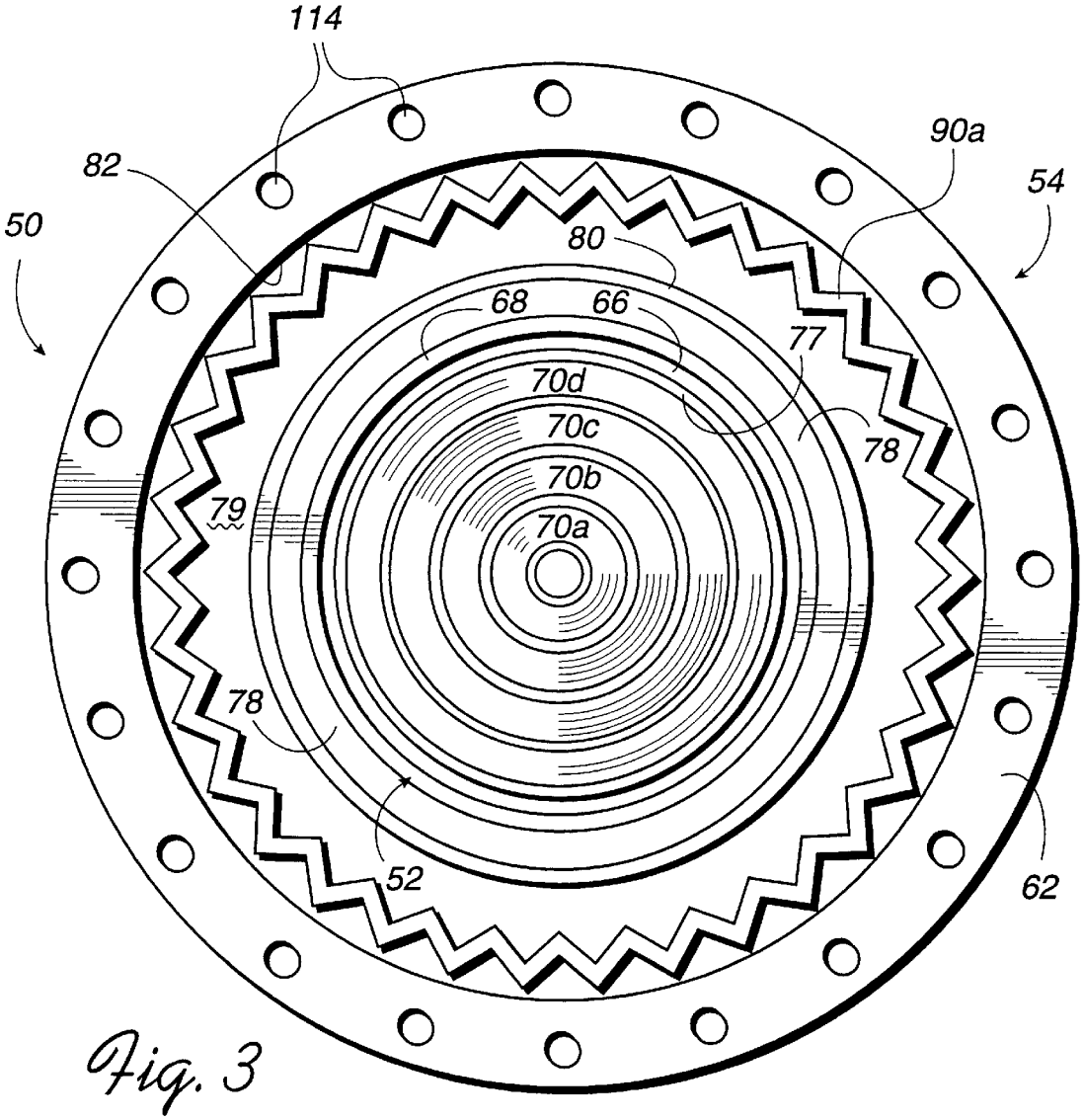
FIG. 3 is a view of the combination cryopump/getter pump assembly of FIG. 2 as seen along lines 3—3.

FIG. 3 is a view taken along line 3—3 of FIG. 2. As will be appreciated by a study of FIGS. 2 and 3, the cryopump section 52, getter pump section 54, and insulating material 78 are substantially cylindrical in configuration. In the view of FIG. 3, the flange 62 is provided with a number of bolt holes 114 to allow its attachment to a mating flange with a number of bolts (not shown). Active getter element 90*a* is preferably corrugated and formed into an annulus which is attached to the outer wall section 82 of the shell 79. An example of a getter cartridge cross section is described in the aforementioned article "Non-Evaporable Getter Pumps for Semiconductor Processing Equipment" of the *Journal of Ultraclean Technology*, the disclosure of which is incorporated herein by reference. The thermally insulating material 78 is disposed between the cryopump section 52 and the getter pump section 54. This thermally insulating can be pre-formed and fitted between the cryopump section 52 and the getter pump section 54, or it may be formed in place by injecting a foam insulating material between the outer wall of the cryopump section 52 and the inner wall of the getter pump section 54. A chevrons 70*a*–70*d* can be seen within the cryopump section 52, as can the bottom wall 68 of shell 67.

Figure 3A:
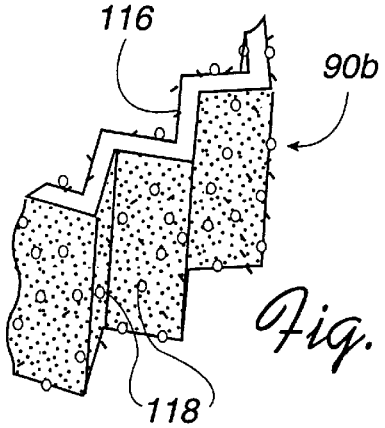
FIG. 3*a* is a perspective view of a small section of the active element of the getter pump section.

In FIG. 3*a*, the portion of active element 90*b* that is encircled by line 3*a* of FIG. 2 is illustrated in greater detail. The active element 90*b* includes a support strip 116 having particles 118 of a gettering material adhered to it. The support strip 116 is preferably corrugated to increase surface area. A suitable gettering material 118, as will be appreciated by those skilled in the art, is available from SAES Getters, Inc., of Lainate, Italy, is preferably adhered to the strip 116.

Figure 4A:
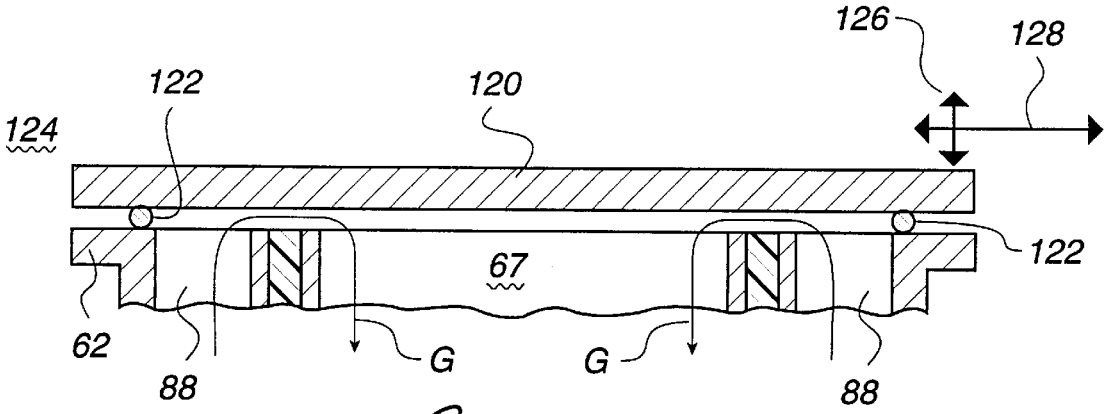
FIG. 4*a* illustrates a first embodiment of a gate member for a gate valve assembly of the present invention.
Figure 4B:
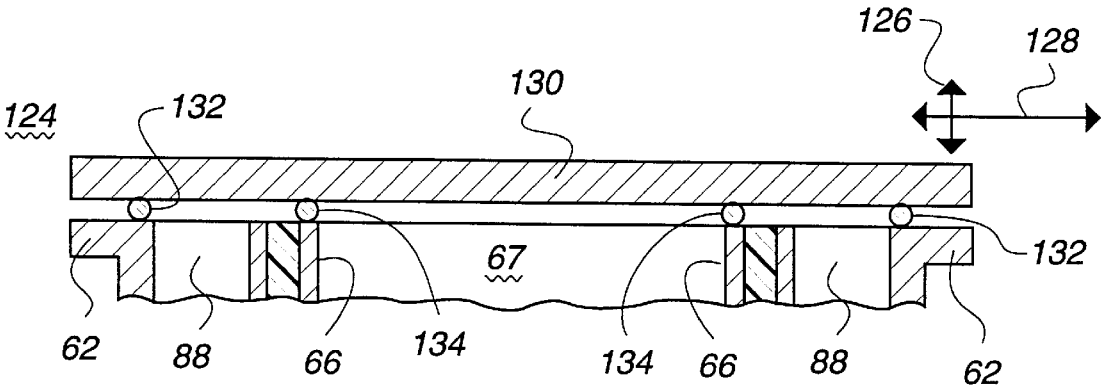
FIG. 4*b* illustrates a second configuration of a gate member for a gate valve assembly in accordance with a second embodiment of the present invention.

FIGS. 4*a* and 4*b* illustrate two alternative gate members used as part of the gate valve assembly 60 of the present invention. In FIG. 4*a*, a gate 120 has a single seal 122 which engages the flange 62 of the getter pump section. The seal 122 can be an "O" ring. As such, the seal 122 substantially isolates the chambers 67 and 88 from the ambient environment 124. However, the seal 122 permits gases to flow between chambers 67 and 88 as indicated by the arrows G. The gate 120 is capable of moving towards and away from the flange 62 as indicated by the arrow 126 and can move laterally as indicated by arrow 128. Movement in the directions indicated by arrows 126 and 128 are controlled by a motorized mechanism (not shown) of the gate valve assembly 60.

In FIG. 4*b*, a gate 130 is provided with a pair of seals 132 and 134. Preferably, seals 132 and 134 are "O" rings. The O ring 132 has a larger diameter, approximately equal to the outer diameter of the getter pump section, and engages the flange 62 of the getter pump section. O ring 134 has a smaller diameter, approximately equal to the diameter of the cryopump section 52, and engages the top of the sidewalls 66 of the cryopump section. Again, chambers 67 and 88 are isolated from the ambient environment 124 by the O ring seals 132 and 134. However, in this embodiment, the chambers 67 and 88 are also isolated from each other by the O ring 134. Because of O ring 134, substantially no gas flow is possible between chambers 67 and 88 when the gate 130 is in the illustrated closed position. The gate 130 is capable of movement towards and away from the flange 62, as indicated by arrow 126, and is capable of lateral movement as indicated by arrow 128.

Figure 5A:
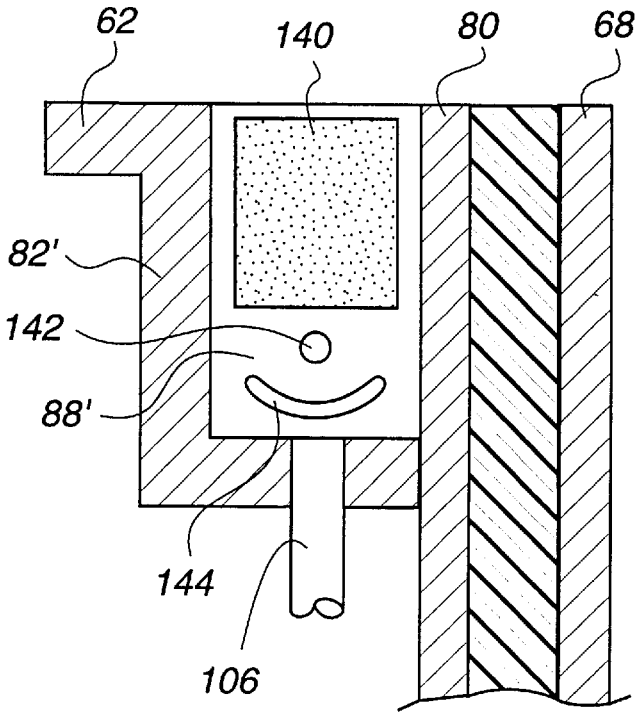
FIG. 5*a* illustrates a first alternate embodiment for the getter elements of a combination cryopump/getter pump assembly of the present invention.

In FIG. 5*a*, a first alternate embodiment for the getter elements is illustrated. In this embodiment, the wall 82' is shortened, and getter plates 140 are provided within a chamber 88'. The getter plates are preferably rectangular and 0.5 inch to 1 inch on a side, and are provided at a spacing of about 0.1" between adjacent plates, and are supported by a suitable mounting assembly (not shown). Preferably, the plates are composed of a porous getter material available from SAES Getters, SpA of Lainate, Italy. The porous getter material will be described in greater detail below. A radiant heater element, such as a quartz lamp 142 is used to heat the getter plates 140 for regeneration. The regeneration process is aided by a reflector (e.g. a polished, curved stainless steel plate) 144.

Figure 5B:
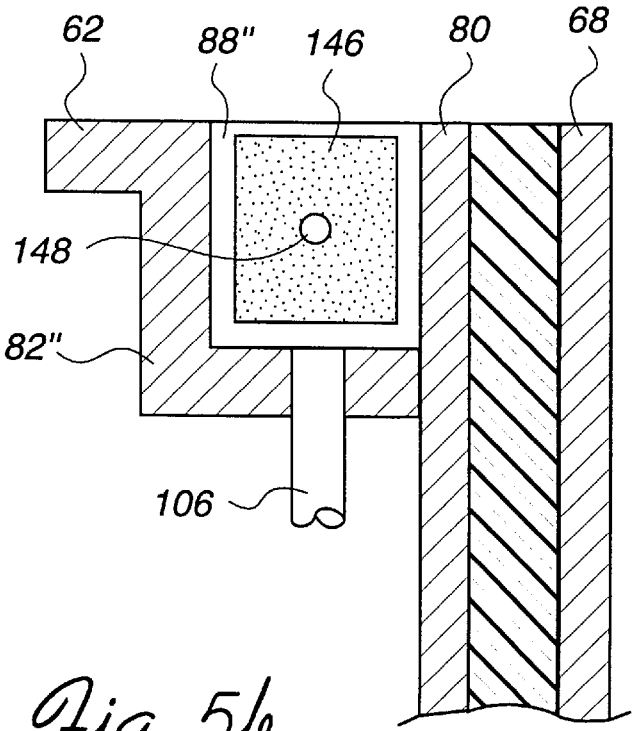
FIG. 5*b* illustrates a second alternate embodiment for the getter elements of a combination cryopump/getter pump assembly of the present invention.

In FIG. 5*b*, a second alternate embodiment for the getter elements is illustrated. In this second embodiment, the wall 82", and getter plates 146 are provided within a chamber 88". These getter plates are indicated to be approximately square, and a preferably 0.5–1.0" along each side. They, again, are preferably supported with a spacing of a fraction of an inch, e.g. 0.05–0.25 of an inch, and most preferably about 0.1" in separation. In this instance, however, the plates 146 are supported by a heating rod 148. The heating rod therefore supports and positions the getter plates, and also servers as a heater for regeneration purposes. The heating rod 148 is preferably an electrical resistance-type heater.

PREFERRED SYSTEM OPERATION

To operate the combined cryopump/getter pump of the present invention, the gate 120 (FIG. 4*a*) or gate 130 (FIG. 4*b*) is opened, if necessary. This is accomplished by first moving the gate 120 away from the flange 62 of getter pump section 54 in a direction indicated by arrow 126, and then withdrawing the gate 120 or 130 from the cryopump inlet 76 and getter inlet 86 by moving the gates to the right, as indicated by arrow 128. Again, the mechanism for accomplishing the movement of the gates 120 or 130 within a gate valve assembly is well known to those skilled in the art of gate valve manufacture.

Once the gate 120 or 130 has been opened, both inlet 76 of the cryopump section and inlet 86 of the getter pump section are in direct communication with the port 58 of the processing chamber. This permits the normal operation of the cryopump section 64 along with the enhanced hydrogen-pumping capabilities of the getter pump section 54. During normal operation, valves 96, 102, 107, and 112 are turned off.

FIRST REGENERATION METHOD

A first regeneration method will be discussed with reference to FIGS. 2, 3, 3*a*, and 4*a*. Since the cryopump section 52 must be regenerated far more frequently than the getter pump section 54, the regeneration of the cryopump section will be discussed first. As stated previously, it is a major advantage of this invention that the cryopump section 52 and the getter pump section 54 can be regenerated separately so as not to prematurely exhaust the capabilities of the getter section 54 due to overly frequent regeneration.

To regenerate the cryopump section 52, the gate member 120 is closed as illustrated in FIG. 4*a*. Valve 102 and valve 112 are closed. First, valve 107 is opened to permit ultra-high purity argon to flow into chamber 88 and over the lip of sidewall 66 into chamber 67, as illustrated by the arrow G in FIG. 4*a*. Then, valve 96 is opened and pump 92 is activated to draw gases from the chamber 67.

The flow of argon gas from chamber 88 into chamber 67 has three major purposes. First, the flow of gas prevents gases released during the regeneration of the active elements of the cryopump section 52 from flowing into the chamber 88 and contaminating the active elements of the getter pump section 54. Secondly, the ultrahigh pure argon gas provides additional gaseous pressure within chamber 67 making the operation of the mechanical pump 92 more efficient. This is advantageous that it prevents back-flow of contaminants from pump 92 into the chamber 67, as may occur if the pressure within chamber 67 is too low. Third, the additional gas aids in heat transfer to the cryogenic elements, speeding up the regeneration of those elements.

The temperature within chamber 67 is allowed to rise to normal room temperature, which permits the gases trapped on the active elements of the cryopump, i.e. in the 15° K array and in the 80° K array, and otherwise within the chamber 67 to be evacuated by pump 92. A heating mechanism (not shown) may be provided to speed up the warming process. At the end of the regeneration cycle all of the valves 96, 102, 107, and 112 are turned off and the gate 120 is removed, as described previously.

The getter pump section 54 is regenerated by first closing the gate member 120. Valve 107 is then opened to allow argon to flow into the getter pump section, and the cryopump section serves as a pump to capture the argon flowing from the getter pump section. Therefore, ultra-high purity argon gas flows from chamber 88 into chamber 67, i.e., in the direction illustrated by the arrow G in FIG. 4*a*. The cryopump section 52 is preferably maintained at its cryogenic temperature, while the active material 90*a*–90*c* is heated to a temperature of approximately 300° C. such as by electrical resistance coil 136.

In the alternate embodiments of FIGS. 5*a* and 5*b*, the getter plates are heated by the quartz lamp 142 or heating rod 148, respectively, instead of by an electrical resistance coil 136. The insulating material 78 between the cryopump 52 and getter pump section 54 thermally isolates these two sections, as does the flow of argon gas from chamber 67 to chamber 88. After completion of the regeneration cycle for the active materials 90*a*–90*c* of the getter pump section 54, the valves 96, 102, 107 and 112 are closed, the pump 92 is turned off, and the gate 120 is opened to permit the operation of the combination pump 50.

It should be noted that each time the getter pump is regenerated by this first method, that the cryopump section must also be regenerated, since the cryopump is pumping the argon (and other gasses released by the regeneration of the getter pump section) flowing out of the getter pump section. However, this is not generally a problem, since cryopumps can be regenerated many more times than typical getter pumps, and since the getter pump portion of the pump combination only need to be regenerated fairly infrequently.

Alternatively, the cryopump can be regenerated concurrently with the regeneration of the getter pump. This can be accomplished by turning off the refrigeration to the cryopump elements, allowing them to warm, and by opening valve 96 and activating pump 92 to draw the argon that flowed from the getter pump chamber 88 into the cryopump chamber 67 from the cryopump chamber 67. This is a preferred method since the cryopump section, if serving as a pump for the purging gas from the getter pump section, would quickly become saturated. Also, the total regeneration time is reduced by this alternate method.

SECOND METHOD FOR REGENERATION

The second method for regeneration is described with reference to FIGS. 2, 3, 3*a* and 4*b*. Again, the regeneration of the cryopump section 52 will be discussed first, and the regeneration of the getter pump section 54 will be discussed second.

To begin regeneration of the cryopump section 52, the gate member 130 is closed, as illustrated in FIG. 4*b*. When in this closed position the O ring 134 prevents gas from flowing between chambers 67 and 88. The temperature within the chamber 67 of the cryopump section 52 is allowed to rise to room temperature (with possible assistance by a heating mechanism), thereby releasing any gases trapped by the active elements 72 and 74. Valves 102 and 107 are closed, valve 96 is open, and pump 92 is activated. The released gases are evacuated by the pump 92. Valve 112 may be opened slightly to provide a flow of ultra-high purity argon into the chamber 67 to enhance the operation of pump 92, as described previously.

The regeneration of getter pump section 54 by this second method begins with the closing of the gate member 130, as illustrated in FIG. 4*b*. Valves 112 and 96 are closed, valve 102 is open, and pump 92 is activated. The active elements 90*a*–90*c* are heated such as by electrical resistance coils 136 (or by the quartz lamp of FIG. 5*a*, or by the heating rod of FIG. 5*b*) to approximately 300° C. to regenerate the active elements. Valve 107 may be opened to provide a flow of ultrahigh purity argon into the chamber 88 to aid in the operation of pump 92.

It should be noted that in both the first and second methods for regenerating the combination pump 50 described above, the chamber 67 of the cryopump section 52 and chamber 88 of the getter pump section 54 are isolated in at least two ways. First, the two chambers 67 and 88 are isolated either by a gas flow, such as gas flow G in FIG. 4*a*, or by a seal such as seal 134 in FIG. 4*b*. This form of isolation prevents contamination of the active elements within one chamber during the regeneration of the active elements of the other chamber. The second form of isolation is thermal isolation which here is primarily provided by the thermally insulating material 78. Other forms of thermal insulation are possible, including an air gap, a vacuum gap, or an active cooling mechanism such as a water jacket.

PREFERRED GETTER MATERIALS

As noted previously, a preferred getter material for use in the getter pump portion of the present invention is a porous getter material available from SAES Getters, SpA of Lainate, Italy. A description of the process for making the porous getter material, and a description of the resultant material, can be found in U.S. patent application Ser. No. 08/820,555, filed Mar. 19, 1997 on behalf of Andrea Conte and Sergio Carella, Attorney Docket No. SAESP032, entitled "A Process For Producing High-Porosity Non-Evaporable Getter Materials and Materials Thus Obtained", the disclosure of which is incorporated herein by reference.

Briefly, the method for making the porous getter begin with providing a powder mixture that includes a metallic getter element having a grain size smaller than about 70 $\mu$m; and at least one getter alloy having a grain size smaller than about 40 $\mu$m. Also included in the mixture is an organic component which is a solid at room temperature and has the characteristic of evaporating at 300° C. substantially without leaving a residue on the grains of either the metallic getter element or the getter alloy when the materials forming the mixture are sintered. In addition, the organic powder has a particle size distribution such that about half of its total weight consists of grains smaller than about 50 $\mu$m, the remainder of the grains being between about 50 $\mu$m and about 150 $\mu$m in size. The powder mixture is then subjected to compression at a pressure less than about 1000 kg/cm$^2$ to form a compressed powder mixture. The compressed powder mixture is sintered at a temperature between about 900° C. and about 1200° C. for a period of between about 5 minutes and about 60 minutes. During the sintering, the organic component evaporates from the compressed powder mixture substantially without leaving a residue on the grains of the metallic getter element and the getter alloy to form thereby a network of large and small pores in the getter material.

In one embodiment, the weight ratio between the metallic getter element and the total amount of getter alloy is between about 1:10 and about 10:1. In another embodiment, the weight ration is between about 1:3 and about 3:1. In another embodiment, the weight of the organic compound consists of up to about 40% of the overall weight of the powder mixture. In some embodiments, the getter alloy used is a Zr-containing or Ti-containing binary or ternary alloy. In one particular embodiment, the getter alloy is a Zr—V—Fe tertiary alloy having a weight percentage composition of Zr 70% —V 24.6% —Fe 5.4% and the metallic getter element is zirconium. In another particular embodiment, a second getter alloy is included that has a strong hydrogen gettering capacity. In one embodiment, the second alloy is a Zr—Al alloy, and in a still more particular embodiment, the alloy is one having the percentage weight composition Zr 84% —Al 16%.

The getter material is then preferably formed into a getter body suitable for use in the getter pump portion of the present invention. In one embodiment, the getter body comprises a plate, but it can alternatively be formed into a pellet, a sheet or a disc. Preferably, the plates are pressed from powder to form solid bodies of porous getter material, as disclosed above.

PREFERRED APPLICATION FOR CRYO/ GETTER PUMP

A preferred application for combination cryopumps/ getter pumps ("cryo/getter pumps") of the present invention is for the production of integrated circuits. More particularly, the cryo/getter pumps of the present invention are attached to semiconductor manufacturing equipment that process semiconductor wafers, such as the aforementioned PVD equipment, to substantially improve the process of making integrated circuits.

A process for making integrated circuits in accordance with the present invention is to provide a combination cryo/getter pump of the present invention with at least one semiconductor manufacturing apparatus used in the production of integrated circuits. The semiconductor manufacturing apparatus is then operated in conjunction with the cryo/getter pump as an essential step in the production of the integrated circuit, e.g. by processing a semiconductor wafer within a PVD machine or an Ion Implant machine, both of which are sensitive to contamination by trace amounts of hydrogen. Since the cryo/getter pump of the present invention is form-compatible with and can be operated in the same way as a standard cryopump, standard integrated circuit manufacturing processes can be used, but with substantially better results. The cryo/getter pump is regenerated as described previously.

While this invention has been described in terms of several preferred embodiments, it is contemplated that alterations, modifications, permutations and equivalents thereof will become apparent to those skilled in the art upon a reading of the specification and study of the drawings. Furthermore, certain terminology has been used for the purposes of descriptive clarity, and not to limit the present invention. It is therefore intended that the following appended claims include all such alterations, modifications, permutations, and equivalents as fall within the true spirit and scope of the present invention.

What is claimed is:

1. A pump comprising:

a cryopump section having a cryopump inlet coupled to a cryopump chamber;

a getter pump section having a getter pump inlet to a getter pump chamber that is isolated from said cryopump chamber, said getter pump section at least partially surrounding said cryopump section; and a coupling mechanism attaching said cryopump section and said getter pump section to a single port of a chamber to be evacuated, such that said cryopump inlet and said getter pump inlet can simultaneously communicate with said port.

2. A pump as recited in claim 1 wherein said getter pump section essentially fully surrounds said cryopump section.

3. A pump as recited in claim 2 wherein said cryopump section and said getter pump section are substantially cylindrical.

4. A pump as recited in claim 2 further comprising a thermal insulator at least partially disposed between said getter pump section and said cryopump section.

5. A pump as recited in claim 3 wherein said getter pump section surrounds said cryopump section and is substantially coaxial therewith.

6. A pump as recited in claim 5 further comprising a substantially cylindrical thermal insulator disposed coaxially between said cryopump section and said getter pump section.

7. A pump as recited in claim 1 further comprising a valve mechanism disposed between said port and said cryopump inlet and said getter pump inlet.

8. A pump as recited in claim 7 wherein said valve mechanism comprises a gate valve having a single seal.

9. A pump as recited in claim 7 wherein said valve mechanism is operative to isolate said cryopump inlet and said getter pump inlet from said port when closed.

10. A pump as recited in claim 9 wherein said valve mechanism does not isolate said cryopump inlet from said getter pump inlet when said port is closed.

11. A pump as recited in claim 9 wherein said valve mechanism isolates said cryopump inlet from said getter pump inlet when said port is closed.

12. A pump as recited in claim 11 wherein said valve mechanism comprises a gate valve having a double seal.

13. A pump as recited in claim 1 wherein said cryopump section includes a 15° K array and a 80° K array.

14. A pump as recited in claim 1 wherein said getter pump section includes at least one support strip supporting a gettering material which is conformed to fit within said getter pump section.

15. A pump as recited in claim 14 wherein said support strip is corrugated and is formed into an at least partial annulus.

16. A pump as recited in claim 15 wherein said support strip is heated by an external resistance heater for regeneration purposes.

17. A pump as recited in claim 1 wherein said getter pump section includes a plurality of getter plates.

18. A pump as recited in claim 17 wherein said getter plates are heated by a radiant heat lamp for regeneration purposes.

19. A pump as recited in claim 18 further comprising a reflector positioned to reflect a portion of the radiant heat from said lamp towards said getter plates.

20. A pump as recited in claim 17 wherein said getter plates are supported by a heater rod for regeneration purposes.

21. A method for regenerating a combination cryopump and getter pump apparatus comprising the steps of:

coupling an integral combination of a cryopump and a getter pump to a single port of a processing chamber;

isolating active elements of said cryopump in a cryopump chamber from active elements of said getter pump in a getter chamber; and regenerating the active elements of at least one of said cryopump and said getter pump.

22. A method for regenerating as recited in claim 21 wherein said step of isolating includes the step of thermally isolating said active elements of said cryopump from active elements of said getter pump.

23. A method for regenerating as recited in claim 21 wherein said step of isolating includes the step of physically isolating said active elements of said cryopump from said active elements of said getter pump with a valve means to prevent gaseous communication between said active elements of said cryopump and active elements of said getter pump.

24. A method for regenerating as recited in claim 21 wherein said step of isolating includes the step of creating an inert gas flow from said getter pump to said cryopump to substantially prevent gas flow from said cryopump to said getter pump during the regeneration of active elements of said cryopump.

25. A method for regenerating as recited in claim 21 wherein said step of regenerating comprises the steps heating said active elements of said getter pump to regenerate getter material of said getter pump.

26. A method for regenerating as recited in claim 25 wherein said getter material is heated to a temperature of at least about 300° C.

27. A method for regenerating as recited in claim 21 wherein said step of regenerating comprises the steps of regenerating said active elements of said cryopump at about room temperature.

28. A method for regenerating as recited in claim 21 wherein said step of coupling includes coupling said integral combination of said cryopump and said getter pump to said single port of a processing chamber with a gate valve mechanism.

29. A vacuum pump assembly comprising:

cryopump means having a cryopump chamber including a first array cooled to close to the temperature of liquid helium and a second array cooled to close to the temperature of liquid nitrogen, said cryopump means being adapted to be coupled to a port of an evacuable chamber;

getter pump means having a getter pump chamber, said getter pump means being coupled to said cryopump means, said getter pump means being adapted to be coupled to said port of said evacuable chamber; and means for coupling said cryopump means and said getter pump means to said port of said evacuable chamber;

whereby said port of said evacuable chamber may be simultaneously pumped by the combination of said cryopump means and said getter pump means.

30. A method for manufacturing integrated circuits comprising:

attaching a vacuum pump to a port of a semiconductor manufacturing apparatus, said vacuum pump including cryopump means having a cryopump chamber including a first array cooled to close to the temperature of liquid helium and a second array cooled to close to the temperature of liquid nitrogen, said cryopump means being adapted to be coupled to said port of said semiconductor manufacturing apparatus, getter pump means having a getter pump chamber, said getter pump means being coupled to said cryopump means, and said getter pump means being adapted to be coupled to said port of said semiconductor manufacturing apparatus, and means for coupling said cryopump means and said getter pump means to said port of said semiconductor manufacturing apparatus, whereby said port of said semiconductor manufacturing apparatus may be simultaneously pumped by the combination of said cryopump means and said getter pump means; and processing semiconductor wafers within said semiconductor manufacturing apparatus utilizing said vacuum pump as an essential part of the manufacturing process for making said integrated circuits.

* * * * *